United States Patent [19]

Petro

[11] 4,366,695

[45] Jan. 4, 1983

[54] METHOD AND APPARATUS FOR HEATING WIRE PRIOR TO DRAWING

[75] Inventor: James Petro, Little Falls, N.J.

[73] Assignee: Westinghouse Electric Corp., Pittsburgh, Pa.

[21] Appl. No.: 181,565

[22] Filed: Aug. 27, 1980

[51] Int. Cl.[3] ..... B21C 9/00

[52] U.S. Cl. ..... 72/286; 72/41

[58] Field of Search ..... 72/41, 43, 44, 46, 47, 72/286, 342, 128

[56] References Cited

U.S. PATENT DOCUMENTS

| | | | |
|---|---|---|---|
| 436,969 | 9/1890 | Edison | 72/286 X |
| 563,462 | 7/1896 | Edison | 72/286 X |
| 1,663,576 | 3/1928 | Von Kossowski | 72/342 X |
| 1,891,338 | 12/1932 | Snell | 72/128 |
| 1,896,613 | 2/1933 | Fowle | 72/286 |
| 2,057,582 | 10/1936 | McKean et al. | 72/286 X |
| 2,187,785 | 1/1940 | Hoyt | 72/286 X |
| 2,203,064 | 6/1940 | Schueler | 72/286 X |
| 2,275,794 | 3/1942 | Murphy | 72/286 X |
| 2,325,342 | 7/1943 | Purcel | 72/286 X |
| 2,337,185 | 12/1943 | Caugherty | 72/286 X |
| 3,349,597 | 10/1967 | Gross | 72/286 |
| 3,573,118 | 3/1971 | Kocks | 148/156 |

*Primary Examiner*—Ervin M. Combs

*Attorney, Agent, or Firm*—B. R. Studebaker

[57] ABSTRACT

A system for heating wire during a wire drawing process which comprises one or more cylindrical silicon carbide tubes each having an aperture in the side wall thereof. A flame projecting burner is situated adjacent the aperture in the side wall of each tube for projecting a flame through the aperture onto a wire passing through the cylindrical tube. The arrangement causes the wire to be heated by direct impingement of the flame onto the wire, residual flame and hot gases redirected by the cylindrical tube longitudinally of the wire and radiant heat from the cylindrical silicon carbide tube.

5 Claims, 4 Drawing Figures

METHOD AND APPARATUS FOR HEATING WIRE PRIOR TO DRAWING

BACKGROUND OF THE INVENTION

This invention relates to the drawing of refractory metal wire and more particularly to a method of heating the wire during the wire drawing process.

Various methods have been employed over the years for heating wire during the wire drawing process. Some of the earliest efforts in heating wire for purposes of drawing the wire were disclosed by Thomas A. Edison in U.S. Pat. Nos. 436,969 and 563,462. In U.S. Pat. No. 436,969 a series of gas fires were directed at a porcelain or nickel tube which constituted a heating chamber for the wire to be drawn. In U.S. Pat. No. 563,462 the wire was heated by direct electrical contact which provided electrical resistance heating of the wire in a non-oxidizing atmosphere.

F. F. Fowle in U.S. Pat. No. 1,896,613 discloses the heating of zinc-coated wire in a preheating furnace in which the wire passes through a central chamber of a furnace which is heated by fires. McKeen et al. in U.S. Pat. No. 2,057,582 discloses a wire drawing and annealing process in which an axial burner is employed to heat the wire before it enters an adjacent cooling chamber. U.S. Pat. No. 2,187,785 to M. A. Hoyt discloses the use of an electric furnace to dry the lubricated wire in which the lubricated wire passes through a resistance tube which is electrically resistance heated to perform the heating function prior to drawing. In U.S. Pat. No. 2,325,342 there is disclosed a gas heating chamber which heats the wire after it has been reduced by the drawing die and before the wire enters a cooling chamber.

At least some manufacturers in present day refractory wire drawing processes employ a plurality of flames to dry the lubricant on the wire and to preheat the wire before it enters the wire drawing die. This system generally involves a large number of gas fires impinging directly on the wire and creates a high noise level, tremendous heat in the surrounding environment and utilizes an excessive amount of gas involving a substantial energy waste.

SUMMARY OF THE INVENTION

In accordance with the present invention sixteen drying fires and thirty-two preheat fires have been replaced by three gas-fired burners with the consequential reduction in gas usage from 100 cubic feet per hour to 10 cubic feet per hour by passing the wire through one or more cylindrical, tubular tunnels having heat retaining characteristics and an opening in the side wall thereof. A single burner fire is directed into the opening to impinge on wire passing through the tubular tunnel whereby the wire is heated by direct impingement on the flame, by flame and hot gases redirected longitudinally of the wire by the tubular member and by radiant heat from the tubular member side wall. The cylindrical heat retaining tubular member is preferably a silicon carbide tube.

BRIEF DESCRIPTION OF THE DRAWING

Many of the attendant advantages of the present invention will become more readily apparent and better understood as the following detailed description is considered in connection with the accompanying drawing in which.

DESCRIPTION OF THE PREFERRED EMBODIMENT

Figure 1:
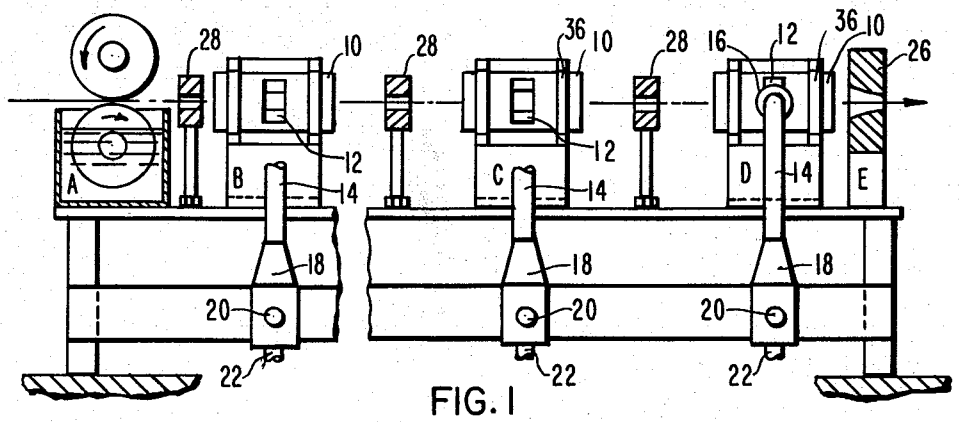
FIG. 1 is a schematic side elevation view of the wire drawing system of this invention.

Referring now in detail to the drawing wherein like reference characters represent like parts throughout the several views, there is illustrated in FIG. 1 a schematic illustration of a typical wire drawing process modified in accordance with the present invention. Previously, the process for reducing the diameter of molybdenum wire involved the passing of the wire through a station A at which the wire is coated with a lubricant as, for example, Aquadag, a water-graphite emulsion. At station B a plurality of vertically oriented gas burners, for example sixteen, were employed to dry the lubricant by passing the wire through the tips of the vertically oriented flames. Prior to passing the wire through the drawing die at station E the wire must be preheated to a predetermined temperature and in the past this was accomplished by separate sets, sixteen each, vertically oriented gas flames at stations C and D with the wire again passing through the tips of the vertically oriented flames. This operation consumed approximately 100 cubic feet of gas per hour to properly prepare the tungsten wire for diameter reduction through the drawing die at station E.

In accordance with the present invention, the tubular silicon carbide elements 10 have been placed at stations B, C and D as illustrated in FIG. 1. These cylindrical tubular silicon carbide elements 10 have an aperture 12 cut in the side wall thereof for receiving a flame from a horizontally directed burner 14 which includes a nozzle 16 and a mixing chamber 18 wherein the air from line 20 and gas from line 22 are mixed to provide the proper heating flame 24 which is projected through the aperture 12 into the interior of the cylindrical tubular silicon carbide body 10.

In operation, the wire proceeds from a spool (not shown) through the lubricant applicator at station A where a water-graphite emulsion is coated onto the wire. The wire next proceeds to the lubricant drying station B where a single gas flame 2 directed through the aperture 12 in the cylindrical tubular member 10 dries the lubricant. The wire then proceeds through the preheat stations C and D where similar gas burners 16 project flames through apertures 12 in identical silicon carbide members 10. The preheated wire is then pulled through the diameter reduction die 26 at station E where it is wound onto a pulling capstan (not shown). A plurality of wire guides 28 are provided between the various operating stations to maintain the wire in alignment and prevent the wire from sagging. The three gas burners 16 replace forty-eight vertical gas fires previously employed to dry the lubricant and heat the wire during the wire drawing process. By employing the apertured silicon carbide cylindrical tubular members 10 at each of the stations B, C and D, the gas consumption has been reduced from about 100 cubic feet per hour to about 10 cubic feet per hour with an additional, not insignificant, improvement in work area conditions. By employing the system of this invention the temperature and noise level in the work area has been substantially reduced.

Figure 4:
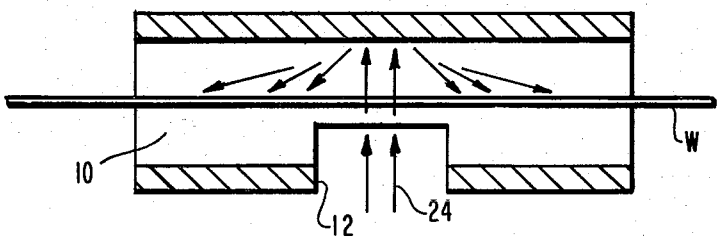
FIG. 4 is a sectional view taken along the line IV—IV of FIG. 3.
Figure 3:
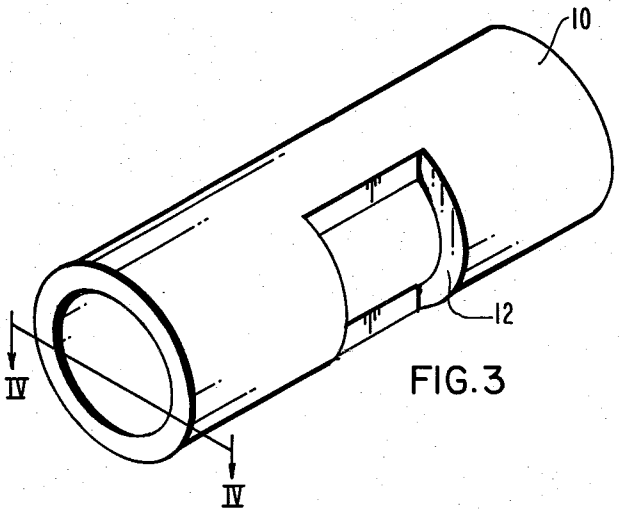
FIG. 3 is an isometric view of the cylindrical tubular heating element of this invention.

The considerable energy savings accomplished by this invention results from the fact that the wire W is heated in three modes by employing the silicon carbide cylindrical tube. First, direct impingement of the flame on the wire, heats the wire in substantially the same manner as the previous fires, however, the hot gases and residual flame flow longitudinally of the wire out of the ends of the tubular cylinder as illustrated in FIG. 4 and continues to heat the wire over a substantial length. Additionally, the silicon carbide tube rapidly acquires a cherry red appearance or incandescence and radiates that heat back into the chamber defined by the tube to provide additional heating to the wire W.

Figure 2:
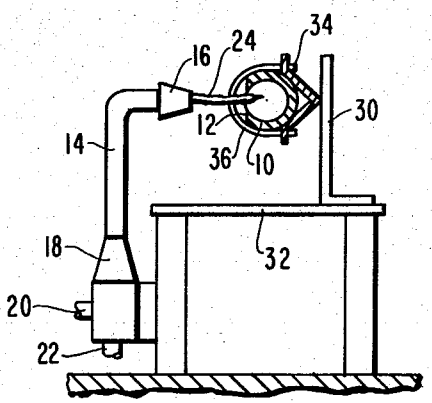
FIG. 2 is a schematic end elevation view of one of the heating stations with the tubular member in section.

The cylinders 10 may be mounted in the wire drawing line in any convenient manner. For example, as best illustrated in FIG. 2, an L-shaped stand 30 can be mounted to the wire drawing table 32 and a V-shaped bracket 34 welded or otherwise secured to the L-shaped stand 30. The cylindrical tubes 10 can be then secured in the V-shaped bracket by means of U bolts 36, hose clamps or any other convenient means.

Although silicon carbide tubes have been illustrated and described because of their good heat retention characteristics, it should be understood that the apertured cylindrical tube 10 could be made from steel, cast iron, Inconel or similar materials.

What is claimed is:

1. In a wire drawing process the improvement comprising:

(a) passing the wire through a cylindrical tubular member having heat retaining characteristics and an opening in the side wall thereof and;

(b) heating said wire by:

(1) laterally directing a single burner flame into the opening perpendicular to the wire path, and impinging said single burner flame directly on said wire, by (2) redirecting a portion of said flame which does not impinge on said wire, and hot gases generated by said flame in both directions longitudinally along said wire and by (3) exposing said wire to radiant heat generated from said member side walls heated by said flame and said hot gases.

2. The improved wire drawing process according to claim 1 wherein said wire is passed through a plurality of spaced cylindrical tubular members each having an opening in the side wall and a burner associated therewith.

3. The improved wire drawing process according to claim 1 wherein said cylindrical tubular members are cylindrical silicon carbide tubes.

4. A heating device for heating wire in a wire drawing process, said heating device including:

a cylindrical heat retaining tubular member having an aperture in the side wall thereof; and a single flame projecting burner situated adjacent said aperture in the side wall of said tubular member constructed and arranged to project the flame laterally into said tubular member through said aperture perpendicular to the center line of said tubular member to heat a wire traveling through said tubular member, said wire being heated by (1) directly impinging said flame thereon, by (2) redirecting a portion of said flame which does not directly impinge on said wire, and hot gases generated by said flame, in both directions longitudinally along said wire and by (3) exposing said wire to radiant heat generated from said tubular member side walls heated by said flame and said hot gases.

5. The heating device of claim 4 wherein said cylindrical heat retaining tubular member is a silicon carbide member.

* * * * *